US005908996A

United States Patent [19]

Litterst et al.

[11] Patent Number: 5,908,996

[45] Date of Patent: Jun. 1, 1999

[54] DEVICE FOR CONTROLLING A MUSICAL PERFORMANCE

[75] Inventors: George F. Litterst, Newton Centre, Mass.; Frank M. Weinstock, Cincinnati, Ohio

[73] Assignee: TimeWarp Technologies Ltd, Newton Centre, Mass.

[21] Appl. No.: 08/957,599

[22] Filed: Oct. 24, 1997

[51] Int. Cl.[6] ..... G10H 5/00

[52] U.S. Cl. ..... 84/600; 84/670; 84/687; 200/56 A

[58] Field of Search ..... 84/600, 645, 652, 84/670, 678, 687, 701, 711; 307/119–122; 200/56 A

[56] References Cited

U.S. PATENT DOCUMENTS

| | | | |
|---|---|---|---|
| 4,341,140 | 7/1982 | Ishida | 84/1.03 |
| 4,471,163 | 9/1984 | Donald et al. | 178/22.08 |
| 4,562,306 | 12/1985 | Chou et al. | 178/22.08 |
| 4,593,353 | 6/1986 | Pickholtz | 364/200 |
| 4,602,544 | 7/1986 | Yamada et al. | 84/1.01 |
| 4,621,321 | 11/1986 | Boebert et al. | 364/200 |
| 4,630,518 | 12/1986 | Usami | 84/1.03 |
| 4,651,612 | 3/1987 | Matsumoto | 84/1.03 |
| 4,685,055 | 8/1987 | Thomas | 364/200 |
| 4,688,169 | 8/1987 | Joshi | 364/200 |
| 4,740,890 | 4/1988 | William | 364/200 |
| 4,745,836 | 5/1988 | Dannenberg | 84/1.03 |
| 5,034,980 | 7/1991 | Kubota | 380/4 |
| 5,056,009 | 10/1991 | Mizuta | 364/200 |
| 5,113,518 | 5/1992 | Durst, Jr. et al. | 395/550 |
| 5,131,091 | 7/1992 | Mizuta | 395/725 |
| 5,177,311 | 1/1993 | Suzuki et al. | 84/600 |
| 5,192,823 | 3/1993 | Suzuki et al. | 84/600 |
| 5,350,881 | 9/1994 | Kashio et al. | 84/622 |
| 5,455,378 | 10/1995 | Paulson et al. | 84/610 |
| 5,491,751 | 2/1996 | Paulson et al. | 380/25 |
| 5,521,323 | 5/1996 | Paulson et al. | 84/610 |
| 5,585,585 | 12/1996 | Paulson et al. | 84/610 |
| 5,648,627 | 7/1997 | Usa | 84/600 |
| 5,693,903 | 12/1997 | Heidorn et al. | 84/668 |

FOREIGN PATENT DOCUMENTS 07261751 10/1995 Japan .

OTHER PUBLICATIONS

Mathews, "The Conductor Program and Mechanical Baton," from *Current Directions in Computer Music Research* (Abstract Only), pp. 263–281, Cambridge, MA, USA, MIT Press, 1989.

Allen et al., "Tracking Muscial Beats in Real Time", *International Computer Music Association,* pp. 140–143, (1990).

Bloch et al., "Real–Time Computer Accompaniment of Keyboard Performances", *Proceedings of the 1985 International Computer Music Conf.,* pp. 279–290 (1985).

Capell et al., "Instructional Design and Intelligent Tutoring: Theory and the Precision of Design", *Jl. of Artificial Intell. in Educ.,* vol.:4(1), pp. 95–121 (1993).

Dannenberg, "The Computer as Accompanist", *CHI'86 Proceedings,* pp. 41–43, (Apr. 1986).

Dannenberg, "Music Representation Issues, Techniques, and Systems", *Computer Music Journal,* vol.:17(3), pp. 20–30 (1993).

(List continued on next page.)

*Primary Examiner*—William M. Shoop, Jr.
*Assistant Examiner*—Marlon T. Fletcher
*Attorney, Agent, or Firm*—Testa, Hurwitz & Thibeault LLP

[57] ABSTRACT

A device which can be used to control a musical performance contains a sensor which outputs an electrical signal. The sensor may be formed by providing a fixed contact and a hollow contact, wherein movement of the device causes the contacts to meet. Other features of the device include a user-adjustable sensitivity feature, a button for starting/stopping, and a sliding switch for sending volume information to the playback devices. The device may be provided as part of a system which includes a score-following apparatus.

29 Claims, 2 Drawing Sheets

OTHER PUBLICATIONS

Dannenberg, "Results from the Piano Tutor Project", *The Fourth Biennial Arts & Technology Symposium, the Center for Arts & Tech. at CT College,* pp. 143–150 (Mar. 4–7, 1993).

Dannenberg, "Software Support for Interactive Multimedia Performance", *Interface,* vol.:22, pp. 213–228 (1993).

Dannenberg, "Human–Computer Interaction in the Piano Tutor", *Multimedia Interface Design,* pp. 65–78 (1992).

Dannenberg, "Practical Aspects of a Midi Conducting Program", *Proceedings of the 1991 Int'l Computer Music Conf. Computer Music Assoc.,* pp. 537–540 (1991).

Dannenberg, "Software Support for Interactive Multimedia Performance", *Proceedings the Arts and Technology, The Center for Art & Tech. at CT College,* pp. 148–156 (1991).

Dannenberg, "Real–Time Computer Accompaniment", *Handout of Acoustical Society of America,* pp. 1–10 (May 1990).

Dannenberg, "An Expert System for Teaching Piano to Novices", *International Computer Music Assoc.,* pp. 20–23 (1990).

Dannenberg, "Recent Work in Real–Time Music Understanding by Computer", *Music, Language, Speech and Brain, Wenner–Gren Int'l Symposium Series,* vol.:59, pp. 194–202 (1990).

Dannenberg, "Real Time Control for Interactive Computer Music and Animation", *The Arts & Tech. II: A Symposium, CT College,* pp. 85–95 (1989).

Dannenberg, "Real–Time Scheduling and Computer Accompaniment", *Current Directions in Computer Music Research,* edited by Max. V. Mathews & John R. Pierce, MIT Press, Camb., MA, pp.225–261 (1989).

Dannenberg, "New Techniques for Enhanced Quality of Computer Accompaniment", *ICMC Proceedings,* pp. 242–249 (1988).

Dannenberg, "Following an Improvisation in Real Time", *ICMC Proceedings,* pp. 241–248 (1987).

Dannenberg, "An On–Line Algorithm for Real–Time Accompaniment", *ICMC '84 Proceedings,* pp. 193–198 (1985).

Grubb et al., "Automated Accompaniment of Muscial Ensembles", *Proceedings of the 12th Nat'l Conf. on Artificial Intel,* pp. 94–99 (1994).

Lifton et al., "Some Technical and Aesthetic Considerations in Software for Live Interactive Performance", *ICMC '85 Proceedings,* pp. 303–306 (1985).

McKee, "Vivace", *Bandworld, The Int'l Band Magazine,* (Oct.–Dec., 1989).

"Music to Your Ears", *Rolling Stone,* (Dec. 1, 1994).

Puckette et al., *ICMC Proceedings,* ICMA pub. pp. 182–185 (1992).

Vercoe, "The Synthetic Performer in the Context of Live Performance", *ICMC '84 Proceedings,* pp. 199–200 (1985).

Vercoe et al., "Synthetic Rehearsal: Training the Synthetic Performer", *ICMC '85 Proceedings,* pp. 275–289 (1985).

Weinstock, "Demonstration of Concerto Accompanist, a Program for the Macintosh Computer", pp. 1–3 (Sep. 1993).

"Welcome to the Vivace Room", *Musical Merchandise Review,* pp. 124–127 (Jan. 1995).

Cavaliere et al., "From Computer Music to the Theater: The Realization of a Theatrical Automation", *Computer Music Journal*, vol.:6(4) (Winter 1982).

Kowalski et al., "The N.Y.I.T. Digital Sound Editor", *Computer Music Journal,* vol.:6(1) (Spring 1982).

Roads, "A Report on SPIRE: An Interactive Audio Processing Environment", *Computer Music Journal*, vol.:7(2) (Summer 1983).

DEVICE FOR CONTROLLING A MUSICAL PERFORMANCE

CROSS-REFERENCE TO RELATED APPLICATIONS

This application claims priority to co-pending provisional patent application Ser. No. 60/029,794, filed Oct. 25, 1996, the contents of which are incorporated herein by reference.

FIELD OF THE INVENTION

The invention involves a device for controlling performance of a musical score and, in one embodiment, a device simulating a conductor's baton for controlling performance of a musical score.

BACKGROUND OF THE INVENTION

In the field of musical performance, constant practice is necessary regardless of whether one is a solo performer that needs to practice a performance that will be accompanied by a number of other musical artists, or one is a conductor who will need to conduct numerous musical artists in a performance. A problem arises, however, when the musical piece that one is practicing requires the participation of a number of different musical artists to be practiced properly. For example, a human conductor may need to practice instructing a group of human musicians in their performance of a particular piece. The conductor may not be able to assemble a sufficient number of musicians to allow him or her to practice conducting, and while the conductor may conduct along with the prerecorded piece, this is not optimal since variations in the conductor's movements will not be reflected in the performance of the piece. Similarly, during a live performance, if there is an insufficient number of musicians to play all of the parts in the musical score, a conductor may need to conduct both human musicians and a musical apparatus capable of playing the missing parts.

The conductor may employ a number of electronic instruments controlled by an automated system that is capable of tracking and following musical scores, such as the system disclosed in U.S. Ser. No. 08/878,638, the contents of which are incorporated herein by reference. However, the conductor still requires a device which allows the motion of the baton to control the performance of the musical piece by both the automated system and human musicians, if any.

In the traditional manner of conducting a musical ensemble, a conductor waves a stick, known as a baton, in the air. Traditionally, the direction of motion, including the change of direction, communicates tempo and beat information to human musicians who are being directed. Additionally, the amplitude of the conducting motions are traditionally used to communicate information as to how loud to play. A conductor typically communicates the incident of a musical beat by suddenly changing direction in an area roughly in the center of his/her body. Such a sudden change of direction is known as an ictus.

SUMMARY OF THE INVENTION

The present invention relates to an input device which enables a user to conduct music playback in a manner which closely resembles traditional orchestral conducting. The sensitivity of the device may be altered to adjust for the particular user's conducting mannerisms and expressiveness. The described invention effectively senses beats indicated by the conductor with minimal spurious signals. In one embodiment, the device simulates a traditional conductor's baton, which allows a conductor to practice naturally.

In one aspect, the present invention relates to a device for controlling performance of a musical score. The device includes a device body that encloses a moveable, hollow contact and a fixed contact. When the conductor signals a beat by an ictus, the moveable, hollow contact makes contact with the fixed contact and signals the beat. In some embodiments, the device is provided with an output port. The beat signal can be transmitted from the output port to external equipment, such as a score-following system, an individual MIDI device, or a computer.

In another aspect, the present invention relates to a device for controlling performance of a musical score. The device includes a device body that encloses an orientation sensing means. The orientation sensing means detects a change in direction of the movement of the device body, and causes the orientation sensing means to signal that a musical beat has occurred. In one embodiment, the orientation sensing means is a gyroscope. In another embodiment, the orientation sensing means is a mercury switch.

The device for controlling performance of a musical score may be part of a greater system which includes a score-following apparatus. In these systems, the musical beat signals from the baton are communicated to the score-following apparatus and instruments which associated with the score-following apparatus are instructed as to how fast to render the musical performance.

BRIEF DESCRIPTION OF THE DRAWINGS

The invention is pointed out with particularity in the appended claims. The above and further advantages of this invention may be better understood by reference to the following description taken in conjunction with the accompanying drawings, in which:

DETAILED DESCRIPTION OF THE INVENTION

Figure 1:
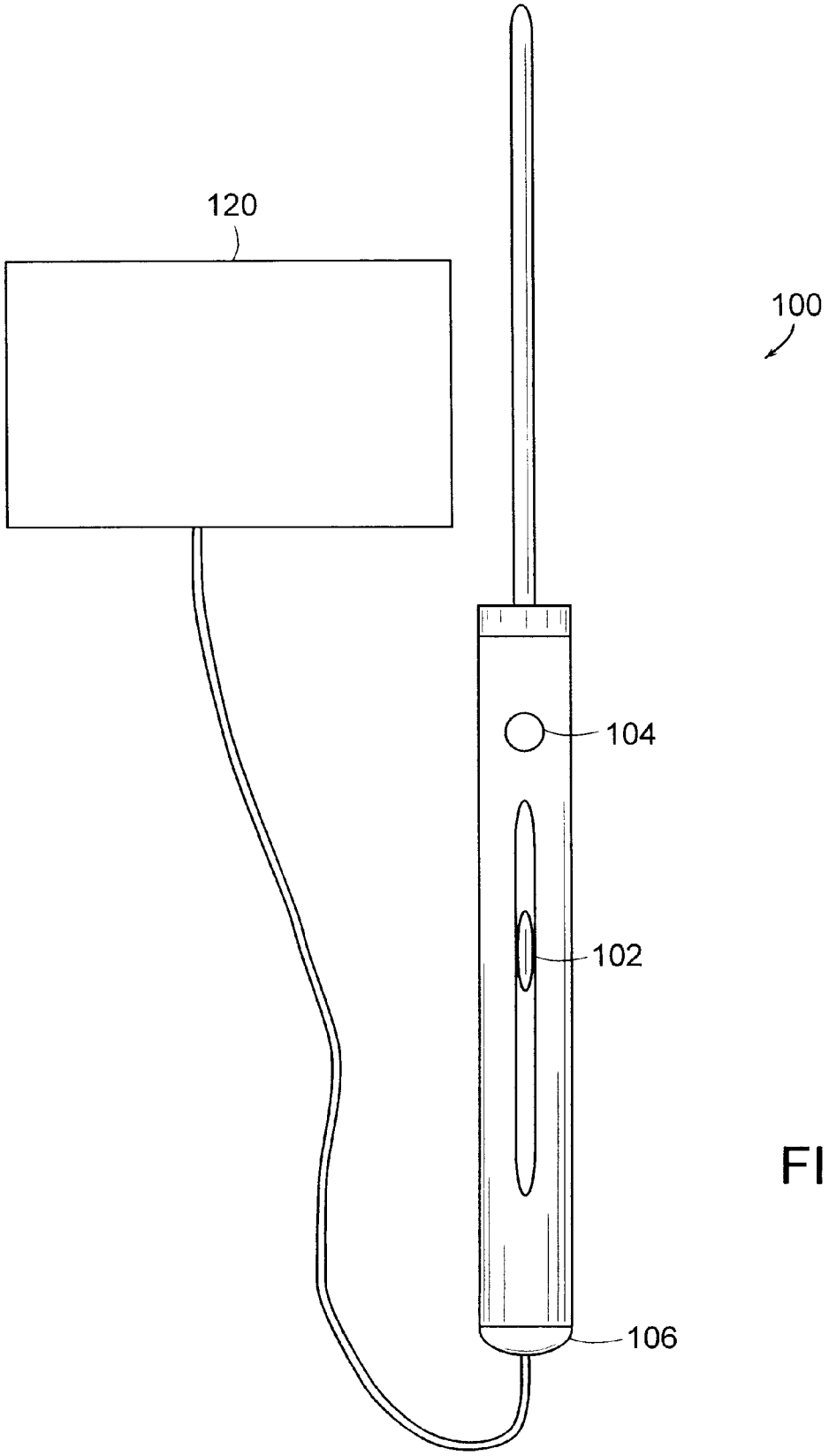
FIG. 1 is an external view of an embodiment of the input device of the present invention that simulates a conductor's baton.

An embodiment of the input device 100 designed to look similar to a traditional conductor's baton is shown in FIG. 1. Since the input device 100 shown in FIG. 1 simulates a traditional conductor's baton, it can be used to direct human musicians as well as electronic instruments. The device 100 may be provided in a form other than a conductor's baton. For example, the device 100 could be provided as a enclosure and an associated strap, allowing the device 100 to be affixed to the arm or leg of a visual performer, such as a dancer. In this embodiment, the device 100 could be configured so that the dancer's actions control the performance of a score associated with the dance being performed.

A volume switch 102 may be provided on the device 100 allowing the conductor to control the volume of any playback devices controlled by the device 100 relative to the performance volume of any human musicians that may be present. A start/stop button 104 can also be provided for starting and stopping any associated playback devices. In some embodiments, a stop/pause button is provided instead of a stop/start button. In other embodiments, a separate pause button may be provided in addition to a start/stop button. Other buttons may be provided to control instruments associated with an automatic score-following apparatus to which the device 100 is connected. Such buttons may allow a location in a score to be marked to allow the performance to return to the marked passage, may rewind the performance, may forward the performance, or may apply audio effects to all or one of the accompanying instruments.

If provided, the volume switch 102 may be a sliding switch, a potentiometer, or any other device that provides an intensity signal. In other embodiments, the device 100 may be provided with a mechanism for providing an external indication of a beat signal. The external indication may be visual, such as an LCD, or aural, such as a clicking noise produced by a speaker. If visual, the external indication of the beat signal may be disposed at any position on the outside of the device body. For example, in the embodiment shown in FIG. 1, the external indication may be disposed at the very tip of the baton in order to facilitate following of the conductor's motions by human musicians.

The device 100 may also be provided with an output port 106 for communicating electrical information out of the device 100. In some embodiments the output port 106 may transmit a simple train of electrical pulses. In other embodiments, the output port 106 may output MIDI data. The device 100 may be connected to a device via a wire, as shown in FIG. 1. To facilitate connecting a wire to the device 100, the output port 106 may be provided with any connection mechanism commonly used, such as an RJ-11 jack, an RS-232 port, a MIDI connector, a BNC connector or an RCA jack. Alternatively, the output port 106 may include a wireless means of communication such as an infrared or radio wave transmitting device.

Figure 2:
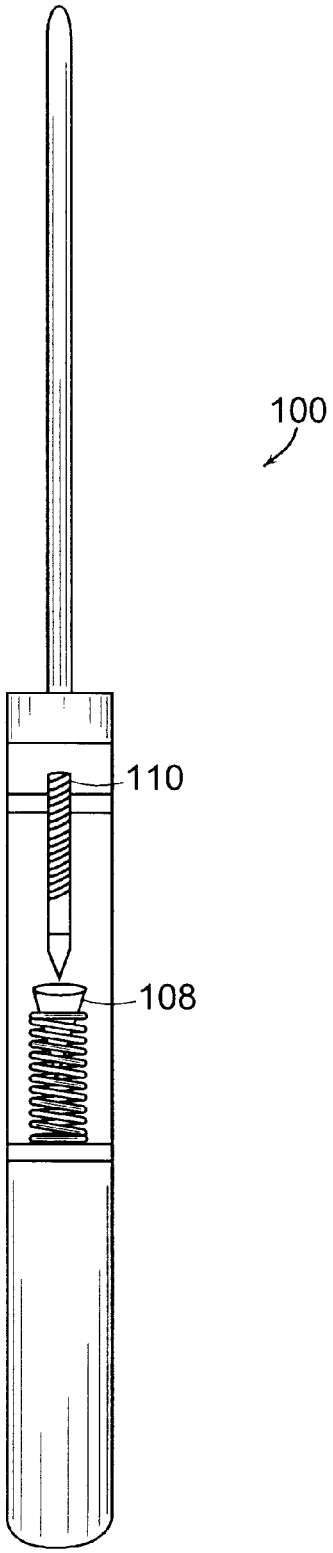
FIG. 2 is a sectional view of an embodiment of the input device of the present invention that simulates a conductor's baton.

Referring now to FIG. 2, the device 100 houses a moveable, hollow contact 108 and a fixed contact 110. A change in motion of the device 100 caused by an ictus results in the hollow contact 108 moving into contact with the fixed contact 110. Thus, the device 100 is able to sense the moment of each musical beat. Moveable contact 108 can be spring mounted, mounted on a lubricated sliding mechanism, or mounted on any other mechanism which allows the moveable contact 108 to move transverse to the longitudinal axis of the device 100 in order to contact the fixed contact 110. Any mechanism for converting the physical contact between the fixed contact 110 and the moveable contact 108 into an electrical signal may be used.

In an alternative embodiment, the device 100 houses a moveable, hollow contact 108 and a fixed contact 110 in which the moveable, hollow contact 108 is mounted on a spring, a lubricated sliding mechanism, or another mechanism which allows the moveable, hollow contact 108 to move longitudinally along the baton to contact the fixed contact 110. In this embodiment, the mounting mechanism should provide some resistance to transverse motion. Mounting mechanisms providing strong resistance to transverse motion should be avoided so that device 100 motion, and therefore moveable contact 108 motion, transverse to the longitudinal axis of the device 100 is not translated into longitudinal motion.

In the embodiment shown in FIG. 2, the moveable contact 108 is a hollow cone. Any hollow shape may be used to provide the moveable contact 108, such as a hollow cylinder, a hollow series of concentric cylinders having incrementally decreasing radii, or a hollow cube. The inner wall of the moveable contact 108 may be coated with a substance enhancing the signal produced when the moveable contact 108 touches the fixed contact 110. Such a material may be copper, gold, silver, or other conductive substances or alloys. If the moveable contact 108 is provided as a hollow cone, the shape of the cone may be chosen to provide a particular range of responsiveness (i.e., how much motion the device 100 must undergo for the hollow contact 108 to contact the fixed contact 110) to the device 100. For example, a short, wide, conical contact 108 would result in a device 100 having a large range of responsiveness but would have only a rough adjustment mechanism due to the steep slope of the cone. Alternatively, a narrow, conical contact 108 would have a narrower range of responsiveness but a finer granularity of control.

The fixed contact 110 may also have different shapes. The contact 110 may be, for example, a cylinder, a cylinder having a conical tip, or a cylinder having a hemispherical tip. Although FIG. 2 shows a fixed contact 110 provided with a tip having the same shape as the moveable contact 110, selection of the shape of the tip of the contact and the shape of the moveable contact 108 is a matter of design choice, and could be different. As noted above with respect to the moveable contact 108, the fixed contact 110 may be coated with a substance enhancing the signal produced when the moveable contact 108 touches the fixed contact 110. The fixed contact 110 may be coated along its entire length or only the tip may be coated.

The fixed contact 110 may be adjustable in order to control the amount of change in motion necessary for the device 100 to sense an ictus. As shown in FIG. 2, the fixed contact 110 can be screw-adjustable. Its pointed end can, therefore, be moved closer to or further from the contact 108. By moving the screw-adjustable contact 110 further into the interior of the moveable contact 108, greater sensitivity to change in the device's movement is created. The fixed contact 110 may be adjustable by any of a number of methods, such as a series of locking detents on the fixed contact 110 which cooperate with an internal mechanism of the device 100 to adjust the position of the fixed contact 110. Alternatively, the fixed contact may be collapsible or extendible in a length-wise manner, allowing the tip of the fixed contact 110 to be positioned at differing distances inside the hollow contact 108.

Similarly, any other method which would convey movement information could be used in the device 100. In one embodiment, a gyroscope is included in the device. The Gyroscope senses a full range of motion and outputs movement information either directly to the output port 106 or to hardware included in the device 100 which translates the output of the gyroscope into a series of codes or electrical information which is output by the device 100. In another embodiment, a mercury switch is included in the device to sense motion, and the output of the mercury switch is output either directly to the output port 106 or to hardware included in the device which translates the output of the mercury switch into a series of codes or electrical information.

In some embodiments, the device 100 may be provided with a microprocessor or discrete logic to process beat signals before they are output. For example, a microprocessor included in the device 100 could debounce the switch by running a program causing the microprocessor to sense two beats that are too close together and remove one from the sequence of output signals transmitted by the output port 106. Alternatively, electrical circuitry may be included in the device 100 to debounce the switch formed by the fixed contact and the hollow contact.

In another embodiment, electrical circuitry may be included to affect the sequence of output signals in any of the ways accompaniment can be altered as described by co-pending application Ser. No. 08/878,638. For example, circuitry could be included that senses when a conductor begins conducting at twice the previous tempo. This is a typical action taken by a conductor preparing to slow the tempo of an orchestra. In such a case, the circuitry could remove every other beat signal from the sequence of output signals so that the proper tempo is indicated.

Referring once again to FIG. 1, the device 100 of the present invention may be provided as part of a system for controlling performance of a musical work. In such systems, the device 100 communicates with a score-following apparatus 120 of the sort described in co-pending application Ser. No. 08/878,638. The device 100 outputs musical beat signals to the score-following apparatus 120. The score following apparatus uses the musical beat signals to track the tempo, i.e., the rate of progress through the musical score and, therefore, instructs associated instruments to perform the musical work at the speed indicated by the conductor. Referring back to FIG. 1, the device 100 may be provided with one or more external controls that affect the instruments' performance of the musical score. For example, a volume switch 102 may be provided on the device 100 so that the conductor can increase or decrease the volume with which the instruments associated with the score-following apparatus perform. Similarly, a start/stop button may be provided which instructs the associated instruments to begin or cease performing the musical work.

Although only preferred embodiments are specifically illustrated and described herein, it will be appreciated that many other modifications and variations of the present invention are possible in light of the above teachings and within the purview of the appended claims without departing from the spirit and intended scope of the invention. Other objects, features and advantages of the invention shall become apparent when the drawings, description and claims are considered.

What is claimed is:

1. A device for controlling performance of a musical score, the device comprising:

a device body enclosing a moveable, hollow contact substantially closed at a first end and substantially open at a second end thereby defining an enclosure, said first end of said hollow contact coupled to said device body; and a fixed contact, said fixed contact having a first end and a second end, said first end of said contact coupled to said device body and said second end of said contact extending into said enclosure defined by said hollow contact, said first end of said fixed contact coupled to said device body at a location remote from said first end of said hollow contact, wherein a change in direction of movement of said device body causes said moveable, hollow contact to come into contact with said fixed contact, signaling incidence of a musical beat.

2. The device of claim 1 wherein said moveable, hollow contact is spring-mounted.

3. The device of claim 1 wherein said fixed contact is adjustable.

4. The device of claim 1 wherein said fixed contact comprises a substantially cylindrical body and a substantially conical tip.

5. The device of claim 1 wherein said moveable, hollow contact is substantially conical.

6. The device of claim 1 further comprising an output port which (i) receives a musical beat signal resulting from said hollow contact and said fixed contact coming into contact with one another, and (ii) transmits the received signal.

7. The device of claim 6 wherein said output port outputs a serial plurality of electrical signals.

8. The device of claim 6 wherein said output port outputs MIDI data.

9. The device of claim 6 wherein said output port further comprises a wireless transmitter.

10. The device of claim 1 further comprising a control disposed on said device body.

11. The device of claim 10 further comprising an output port, said output port transmitting a signal indicative of a state of said control.

12. The device of claim 1 further comprising a microprocessor in electrical communication with said hollow contact and said fixed contact, wherein said microprocessor processes said musical beat signals.

13. The device of claim 12 wherein said beat indicator is a light-emitting diode.

14. The device of claim 1 further comprising a beat indicator disposed on said device body.

15. The device of claim 1 wherein said device has a longitudinal axis and wherein a change in direction of movement of said device body causes said hollow contact to move in a direction transverse to the longitudinal axis of said device and come into contact with said fixed contact, signaling incidence of a musical beat.

16. A device for controlling performance of a musical score, the device comprising:

a device body enclosing a moveable, hollow contact, said hollow contact substantially closed at a first end and substantially open at a second end, thereby defining an enclosure; and an adjustable, stationary contact, said stationary contact having a first end and a second end, said first end of said contact coupled to said device body and said second end of said contact adjustably penetrating into said enclosure defined by said hollow contact, wherein a change in direction of movement of said device body causes said moveable, hollow contact to come into contact with said fixed contact, signaling incidence of a musical beat.

17. The device of claim 16 wherein said moveable, hollow contact is spring-mounted.

18. The device of claim 16 wherein said adjustable, stationary contact is screw-adjustable.

19. The device of claim 16 wherein said adjustable, stationary contact comprises a substantially cylindrical body and a substantially conical tip.

20. The device of claim 16 wherein said moveable, hollow contact is substantially conical.

21. The device of claim 16 further comprising an output port which (i) receives a musical beat signal resulting from said hollow contact and said adjustable, stationary contact coming into contact with one another, and (ii) transmits the received signal.

22. The device of claim 21 wherein said output port outputs a serial plurality of electrical signals.

23. The device of claim 21 wherein said output port outputs MIDI data.

24. The device of claim 21 wherein said output port further comprises a wireless transmitter.

25. The device of claim 16 further comprising a control disposed on said device body.

26. The device of claim 16 further comprising a microprocessor in electrical communication with said hollow contact and said stationary contact, wherein said microprocessor processes said musical beat signals.

27. The device of claim 16 further comprising a beat indicator disposed on said device body.

28. The device of claim 27 wherein said beat indicator is a light-emitting diode.

29. The device of claim 16 wherein said device has a longitudinal axis and wherein a change in direction of movement of said device body causes said hollow contact to move in a direction transverse to the longitudinal axis of said device and come into contact with said adjustable, stationary contact, signaling incidence of a musical beat.

* * * * *